United States Patent [19]

Koizumi et al.

[11] Patent Number: 4,482,837

[45] Date of Patent: Nov. 13, 1984

[54] ROTARY ANODE FOR AN X-RAY TUBE AND A METHOD FOR MANUFACTURING THE SAME

[75] Inventors: Hideo Koizumi, Tokyo; Isamu Koseki, Yokosuka; Tadashi Morita, Kawasaki; Shu Yamazaki; Yoshio Fukuhara, both of Yokohama, all of Japan

[73] Assignee: Tokyo Shibaura Denki Kabushiki Kaisha, Kawasaki, Japan

[21] Appl. No.: 513,955

[22] Filed: Jul. 15, 1983

Related U.S. Application Data

[63] Continuation of Ser. No. 252,192, Apr. 8, 1981, abandoned.

[30] Foreign Application Priority Data

Apr. 11, 1980 [JP] Japan ..... 55-46726
Feb. 18, 1981 [JP] Japan ..... 56-21499

[51] Int. Cl.[3] ..... H01J 35/08
[52] U.S. Cl. ..... 378/144; 378/125
[58] Field of Search ..... 313/330; 378/125, 144

[56] References Cited

U.S. PATENT DOCUMENTS

| | | | |
|---|---|---|---|
| Re. 31,560 | 4/1984 | Devine | 378/125 |
| 3,579,022 | 5/1971 | Hennig | 378/125 |
| 4,119,879 | 10/1978 | Devine | 313/330 |
| 4,132,917 | 1/1979 | Bildstein et al. | 378/144 |
| 4,168,449 | 9/1979 | Koizumi et al. | 378/144 |
| 4,331,902 | 5/1982 | Magendans et al. | 378/144 |
| 4,352,041 | 9/1982 | Hubner et al. | 378/125 |

*Primary Examiner*—Harold Dixon
*Attorney, Agent, or Firm*—Cushman, Darby & Cushman

[57] ABSTRACT

The present invention provides a rotary anode for an X-ray tube which comprises an anode body formed of graphite, a preformed sheet formed of rhenium and bonded to the top surface of the anode body, and a target layer formed of tungsten or an alloy thereof and bonded to the top surface of the preformed sheet. This rotary anode may further comprise a preformed plate formed of molybdenum and interposed between and bonded to the preformed sheet and the target layer. Also disclosed is a method for manufacturing the rotary anode.

3 Claims, 2 Drawing Figures

ROTARY ANODE FOR AN X-RAY TUBE AND A METHOD FOR MANUFACTURING THE SAME

Figure 1:
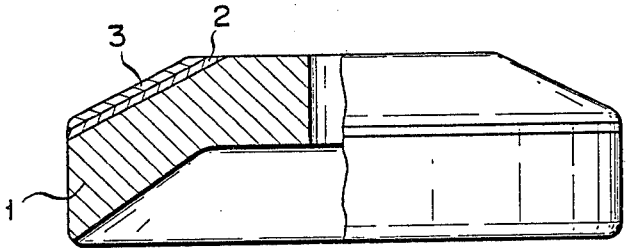

This is a continuation of application Ser. No. 252,192, filed Apr. 8, 1981 now abandoned.

This invention relates to an improvement in a rotary anode for an X-ray tube including an anode body formed of graphite.

Rotary anodes for X-ray tubes with large thermal capacity and capable of delivering high X-ray output are widely used in the medical field.

Conventionally, a rotary anode is formed of tungsten or an alloy thereof or some other metal capable of resisting thermal shock caused by electron beams applied thereto and having good X-ray emissivity, high density and melting point, and great atomic number. Alternatively, there may be used a composite plate formed of a tungsten plate and a relatively thick molybdenum plate as a heat absorber integrally bonded to the back of the tungsten plate.

With the advance of the X-ray technology, however, there has been an increasing demand for a rotary anode with increased thermal capacity which can stand continuous load or high instantaneous load input.

In response to such demand, there has recently been developed a rotary anode which comprises a graphite anode body with small specific gravity and good thermal emissivity, and a target layer formed of tungsten or an alloy thereof and integrally bonded to the top of the anode body.

Conventionally, such rotary anode is manufactured as an integral structure by forming on the graphite anode body of a given shape a vapor-deposited rhenium layer provided by e.g. CVD (chemical vapor deposition) method or a rhenium layer obtained by applying a slurry consisting of rhenium powder and an organic solvent, putting a plate of tungsten or an alloy thereof on the rhenium layer, and hot-pressing the resultant laminated structure in a reducing atmosphere at a temperature of 1,400° to 1,600° C. and a pressure of 150 to 300 kg/cm$^2$.

The rhenium layer used in this case is an intermediate layer which functions to prevent the tungsten plate from being carbonized on the bonding surface between itself and the graphite anode body by carbon diffused from the graphite anode body heated to a high temperature (1,200° to 1,500° C.) by electron beams applied thereto in the use of the rotary anode to reduce the bonding strength at the bonding surface.

With the above-mentioned conventional intermediate layer, however, it is hard fully to prevent the carbonization of tungsten, and the bonding strength between the several layers constituting the rotary anode is not enough.

The object of this invention is to provide a rotary anode for an X-ray tube and a method for manufacturing the same, capable of preventing carbonization of the tungsten plate and ensuring high bonding strength between the several components.

According to this invention, there is provided a rotary anode for an X-ray tube which comprises an anode body formed of graphite, a target layer formed of tungsten or an alloy thereof, and a preformed sheet as an intermediate layer formed of rhenium and interposed between and bonded to the anode body and target layer. The intermediate layer may alternatively be composed of a preformed plate formed of molybdenum and a preformed rhenium sheet bonded to the molybdenum plate. In this case, the preformed molybdenum plate and the preformed rhenium sheet are bonded to the target layer and the graphite anode body, respectively.

In a first method for manufacturing the rotary anode of the invention, the anode body, intermediate layer, and target layer are laminated successively, and then the resultant laminated body is hot-pressed in a vacuum or an inert gas.

In a second method for manufacturing the rotary anode, the intermediate layer and target layer are bonded together by hot-pressing in a reducing atmosphere, and then the resultant bonded structure and the graphite anode body and bonded together by hot-pressing in an inert gas atmosphere. In this invention, it is to be desired that rhenium powder, a mixture of rhenium powder and molybdenum powder, or a paste containing such powder and an organic binder added thereto should be applied as an auxiliary bonding agent between the graphite anode body and intermediate layer or between the intermediate layer and target layer.

Figure 2:
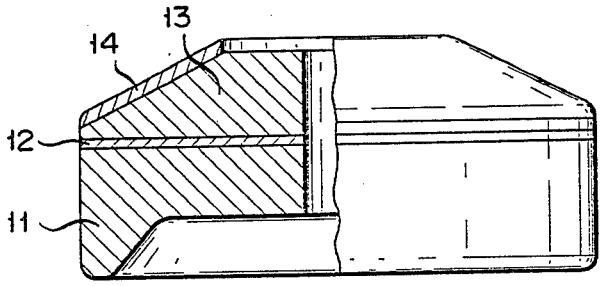

This invention can be more fully understood from the following detailed description when taken in conjunction with the accompanying drawings, in which:

FIG. 1 is a partial sectional view of a rotary anode according to an embodiment of this invention; and FIG. 2 is a partial sectional view of a rotary anode according to another embodiment of the invention.

In this invention, a preformed rhenium sheet constituting an intermediate layer is manufactured by, for example, granulating rhenium powder by means of an organic binder, molding the granulated powder into a sheet by rolling, presintering the sheet to remove the binder therefrom, and then sintering, rerolling, and heat-treating the presintered sheet.

Also, the rhenium sheet may be made by powder metallurgy as it is called. In this method, the rhenium sheet is obtained by, for example, hot-forging, hot-rolling, and cold-rolling rhenium powder (mixed with a binder if necessary) which is molded by means of an isostatic press and sintered in a vacuum. Thus, the rhenium sheet of the invention is sintered minutely, and preformed as an intermediate layer.

Although sheets with various thicknesses may be manufactured by the aforementioned methods, the rhenium sheet used in the rotary anode of the invention preferably has a thickness of 15 to 200 μm. In a rotary anode using such a rhenium sheet as its intermediate layer, as compared with the conventional one having its intermediate rhenium layer formed by CVD method, carbonization of tungsten may more fully be prevented.

A target layer formed of tungsten or an alloy thereof preferably has a thickness of 0.5 to 2 mm.

In the above-mentioned first method for manufacturing the rotary anode of the invention, hot-pressing is performed preferably at a temperature of 1,200° to 1,600° C. and a pressure of 200 to 500 kg/cm$^2$.

In a second method for manufacturing the rotary anode of the invention, primary hot-pressing is executed in a reducing atmosphere such as hydrogen at a temperature of 1,400° to 1,700° C. and a pressure of 100 to 300 kg/cm$^2$. If the temperature and pressure are lower than 1,400° C. and 100 kg/cm$^2$, respectively, the bonding strength at the interface between the several layers constituting the rotary anode will not be great enough. On the other hand, if the temperature and pressure exceed 1,700° C. and 300 kg/cm$^2$, respectively, the bonding strength will increase satisfactorily. In this case, however, the preventive effect against diffusion of carbon provided by the alloying of the rhenium layer will be reduced, so that such excessive temperature and pressure are not practical manufacturing conditions.

Secondary hot-pressing in the second method of the invention is executed by putting a laminated body of the target layer and intermediate layer obtained through the primary hot-pressing on a graphite anode body in an inert gas atmosphere such as nitrogen at a temperature of 1,200° to 1,600° C. and a pressure of 50 to 500 kg/cm$^2$.

The use of the inert gas atmosphere for the secondary hot-pressing makes sufficient the bonding strength between the laminated body and the graphite anode body.

If the temperature and pressure are lower than 1,200° C. and 50 kg/cm$^2$, respectively, the bonding strength between the rhenium sheet and the graphite anode body cannot be great enough. On the other hand, if the temperature and pressure exceed 1,600° C. and 500 kg/cm$^2$, respectively, carbon from the graphite anode body will diffuse during the hot-pressing to carbonize part of the tungsten layer or molybdenum plate overlying the rhenium layer, and frequently causing cracks or fractures in the graphite anode body.

EXAMPLE 1

A paste prepared by mixing rhenium powder and molybdenum powder at a weight ratio of 50:50 and adding an organic binder such as nitrocellulose to the mixture was uniformly applied to a thickness of 10 to 20 μm to a graphite anode body formed in a given shape. A rhenium sheet of 100 μm thickness made in the aforesaid manner was put on top of the resultant structure, the paste agent was further applied to the rhenium sheet, and then a tungsten plate of 1 mm thickness was laid on top of the laminated structure.

Subsequently, the resultant laminated body was put in a hot-press, and kept in a vacuum at a temperature of 1,400° C. and a pressure of 400 kg/cm$^2$ for 60 minutes.

In a rotary anode obtained in this way, as shown in FIG. 1, the bonding strength between the graphite anode body 1 and the rhenium sheet 2 and between the rhenium sheet 2 and the tungsten layer 3 is high, and no carbide is produced on the bonding surface of the tungsten layer 3, so that the tungsten layer 3 will never come off during the operation of the rotary anode.

Accordingly, the target of this invention can provide high X-ray output, ensuring prolonged stable production of large doses of X-rays.

EXAMPLE 2

(1) Primary Hot-pressing

A tungsten plate of 130 mm diameter and 2.5 mm thickness, a molybdenum plate of 130 mm diameter and 20 mm thickness, and a rhenium sheet of 130 mm diameter and 20 μm thickness were prepared. The rhenium sheet, molybdenum plate, and tungsten plate were successively put in layers in a conventional press, and were hot-pressed in a hydrogen atmosphere at a temperature of 1,600° C. and a pressure of 250 kg/cm$^2$. As an auxiliary bonding agent, a paste prepared by adding 0.5 to 10 wt. % of organic binder to rhenium powder or a mixture of rhenium powder and molybdenum powder was applied between these plates and sheet. Thus, an integral laminated body was obtained.

(2) Secondary Hot-Pressing

Subsequently, the aforesaid laminated body was put on an annular or cylindrical graphite anode body of 130 mm outside diameter, 10 mm inside diameter and 30 mm thickness and hot-pressed in a nitrogen atmosphere at a temperature of 1,400° C. and a pressure of 200 kg/cm$^2$. The aforesaid auxiliary agent was applied to the bonding surfaces. Thus obtained was a rotary anode of integral configuration involving no fractures or cracks in the graphite anode body. Such rotary anode is shown in FIG. 2. In FIG. 2, numerals 11, 12, 13 and 14 designate the graphite anode body, rhenium sheet, molybdenum plate, and tungsten plate, respectively.

The molybdenum plate 13 served to increase the bond strength between the rhenium sheet 12 and the anode body 11.

15 rotary anodes were manufactured in this manner. For comparison, a laminated structure including the tungsten plate, molybdenum plate, a vapor-deposited rhenium layer and graphite anode body of the same specifications laminated in succession, was hot-pressed in a nitrogen atmosphere at a temperature of 1,400° C. and a pressure of 200 kg/cm$^2$. 15 rotary anodes were manufactured for each control.

Part of each such rotary anode was cut along the direction of the thickness, and the section was checked for the existence or resultant thickness of a carbide layer in the molybdenum plate.

Further, a bonding strength testing body with the same dimensions and configuration as the rotary anode was manufactured under the same conditions therewith, and the bonding strength between its graphite anode body and rhenium sheet and between its tungsten plate and molybdenum plate was measured.

The results shown in the table below are the average of several measurements.

TABLE

| | Thickness of carbide layer in Mo plate (μm) | Bonding strength between rhenium sheet and anode body (kg/cm$^2$) | Bonding strength between W plate and Mo plate (kg/cm$^2$) |
|---|---|---|---|
| Present Invention | 1~3 | 100~150 | 150~200 |
| Control | 50~200 | 30~50 | 50~120 |

In the rotary anode according to this invention, as is evident from the table above, very little carbide layer is formed in the molybdenum plate, and the bonding strength between several layers, as well as the overall bonding strength, is high. In the control, on the other hand, said properties are poorer.

Although tungsten plates were used for the target layers in the examples herein, tungsten-rhenium alloy plates may also be used for this purpose. The same effect may be obtained with use of doped tungsten plates (tungsten plates doped with $Al_2O_3$, $SiO_2$, $K_2O$, Co, Sn, or Fe).

What we claim is:

1. A rotary anode for an X-ray tube comprising:

an anode body formed of graphite;

a preformed sheet formed of rhenium having a thickness of 15 to 200 μm and bonded to the top surface of said anode body; and a target layer formed of tungsten or an alloy thereof and bonded to the top surface of said preformed sheet by a bonding agent incorporating rhenium paste.

2. A rotary anode according to claim 1 further comprising a preformed plate formed of molybdenum and interposed between and bonded to said preformed sheet and said target layer.

3. A rotary anode according to claim 1, wherein said target layer has a thickness of 0.5 to 2 mm.

* * * * *